US012195267B2

(12) United States Patent
LeDrew

(10) Patent No.: US 12,195,267 B2
(45) Date of Patent: Jan. 14, 2025

(54) BEVERAGE CONTAINER INSULATION SYSTEM

(71) Applicant: Thomas Bradley LeDrew, Yorkton (CA)

(72) Inventor: Thomas Bradley LeDrew, Yorkton (CA)

( * ) Notice: Subject to any disclaimer, the term of this patent is extended or adjusted under 35 U.S.C. 154(b) by 13 days.

(21) Appl. No.: 18/302,961

(22) Filed: Apr. 19, 2023

(65) Prior Publication Data

US 2024/0002131 A1 Jan. 4, 2024

(30) Foreign Application Priority Data

Jul. 4, 2022 (CA) ..... 3166673

(51) Int. Cl.
*B65D 81/38* (2006.01)

(52) U.S. Cl.
CPC ..... *B65D 81/3876* (2013.01)

(58) Field of Classification Search
CPC ..... B65D 81/3876; B65D 81/3879; B65D 81/3881; B65D 81/3883; B65D 81/3886; B65D 81/3888; B65D 81/389; B65D 81/3893; B65D 81/3895; B65D 81/3897
See application file for complete search history.

(56) References Cited

U.S. PATENT DOCUMENTS

| | | | | |
|---|---|---|---|---|
| 3,023,922 | A | 3/1962 | Arrington | |
| 4,194,627 | A | 3/1980 | Christensen | |
| 4,815,999 | A * | 3/1989 | Ayon | B65D 81/3886 446/73 |
| 6,206,223 | B1 | 3/2001 | Wicker | |
| 6,349,846 | B1 | 2/2002 | Meza | |
| 6,604,649 | B1 | 8/2003 | Campi | |
| D530,984 | S | 10/2006 | Bolden | |
| D591,563 | S | 5/2009 | Johnson | |
| 7,677,056 | B2 * | 3/2010 | Panganiban | F25D 3/08 62/457.4 |
| D675,881 | S | 2/2013 | Wamack, Jr. | |
| 10,750,892 | B1 * | 8/2020 | Wegner | F25D 3/08 |
| 2008/0093370 | A1 | 4/2008 | Darsey | |
| 2011/0220670 | A1 | 9/2011 | Poole | |
| 2015/0191293 | A1 * | 7/2015 | Forcella | A47G 23/0233 220/592.16 |
| 2022/0183489 | A1 * | 6/2022 | Kuzminski | F25D 31/007 |

FOREIGN PATENT DOCUMENTS

CA 2300733 A1 9/2001

* cited by examiner

*Primary Examiner* — Javier A Pagan
(74) *Attorney, Agent, or Firm* — NK Patent Law

(57) ABSTRACT

A beverage container insulation system for beverage containers comprises a base and a corresponding top which is hingedly attached thereto. An attachment element on the top magnetically couples with an attachment element integrated on the base, permitting retention of the top out of the way of a user seeking to drink from a beverage container contained in the system. The system can be manufactured of pliable insulated foam or other materials.

13 Claims, 7 Drawing Sheets

BEVERAGE CONTAINER INSULATION SYSTEM

CROSS-REFERENCE TO RELATED APPLICATIONS

This application claims priority to Canadian Patent Application No. 3,166,673, filed on Jul. 4, 2022, the entire contents of which is incorporated by reference herein.

FIELD OF THE INVENTION

This invention is in the field of beverage containers, and more specifically to insulation for beverage containers.

BACKGROUND

There have been many attempts to create an effective and functional insulation system for beverage containers using removable beverage insulators, often made of pliable materials. Such insulation systems are often referred to as beverage sleeves, drink cozies, or drink koozies. These insulation systems will be referred to herein simply as "cozies". Maintaining the temperature of a beverage is desirable for both taste preference and storage purposes. However, due to the individual nature of cozies, creating cozies cheaply that can be stored and transported efficiently so they can be sold cheaply is also desirable.

Many popular iterations of cozies have included padded sleeves that fit around a container and are put into place about the container by pulling the cozy up from the bottom of the container. When used correctly in the right position, the cozies provide insulation to beverages. Once a beverage is empty, the cozy can be removed from the container and attached to a new full container. Such cozies are cheap to produce and provide relatively effective short-term solutions to beverage insulation.

Several attempts in the prior art have been made to provide longer-term insulation solutions. Such attempts have included cozies that, in addition to the sleeve, also contain an insulated top which can enclose beverage containers, often using mating top elements which fit into a matching sleeve or other mating lid elements. A common problem encountered with cozy designs involving mating lid elements is that the lids are often detachable, and thus liable to being misplaced and getting lost. Other issues involving mating lid and body elements are due to the requirement that they be rigid. Over time, the structures involved become worn and may no longer fit into their complementary element, thus disabling the cozy from functioning as intended.

SUMMARY OF THE INVENTION

The present invention is an insulation system for beverage containers. The system includes a base hingedly connected to a top. In a closed position, a beverage container within the insulation system is well insulated. In an opened position, the top of the insulation system is removed from the beverage container and is magnetically retained to an attachment element on the sidewall of the base of the insulation system.

In one aspect, the invention comprises a beverage insulation apparatus movable between an opened position and a closed position. The beverage insulation apparatus comprises a base and a top. The base has a bottom sidewall and the top has a top sidewall. The top sidewall is pivotably connected to the bottom sidewall by a bridging element. A lower attachment element is on the bottom sidewall and an upper attachment element is on the top sidewall. The lower attachment element is unattached to the upper attachment element when the beverage insulation apparatus is in the closed opposition. The lower attachment element magnetically couples with the upper attachment element when the beverage insulation apparatus is in the opened position.

In another aspect, the lower attachment element is magnetic and the upper attachment element is ferromagnetic.

In another aspect, the lower attachment element is ferromagnetic and the upper attachment element is magnetic.

In another aspect, the lower attachment element is magnetic and the upper attachment element is magnetic.

In another aspect, the bridging element is made of a pliable polymer plastic.

In another aspect, the bridging element is made of metal.

In another aspect, the bridging element is made of a sewn fabric material.

In another aspect, the beverage insulation apparatus further comprises a lower closing element on the bottom sidewall and an upper closing element on the top sidewall. The lower closing element is unconnected to the upper closing element when the beverage container apparatus is in the opened position. The lower closing element is connected to the upper closing element when the beverage is in the closed position.

In another aspect, the base further comprises a bottom wall connect to the bottom sidewall.

In another aspect, the base and the top are made of a material selected from the group consisting of pliable foam, pliable polymer plastic, glass, and metal.

In another aspect, the base and the top are made of an insulating material that is between 3 mm to 10 mm thick.

In another aspect, the bottom sidewall is greater in height than the top sidewall.

DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
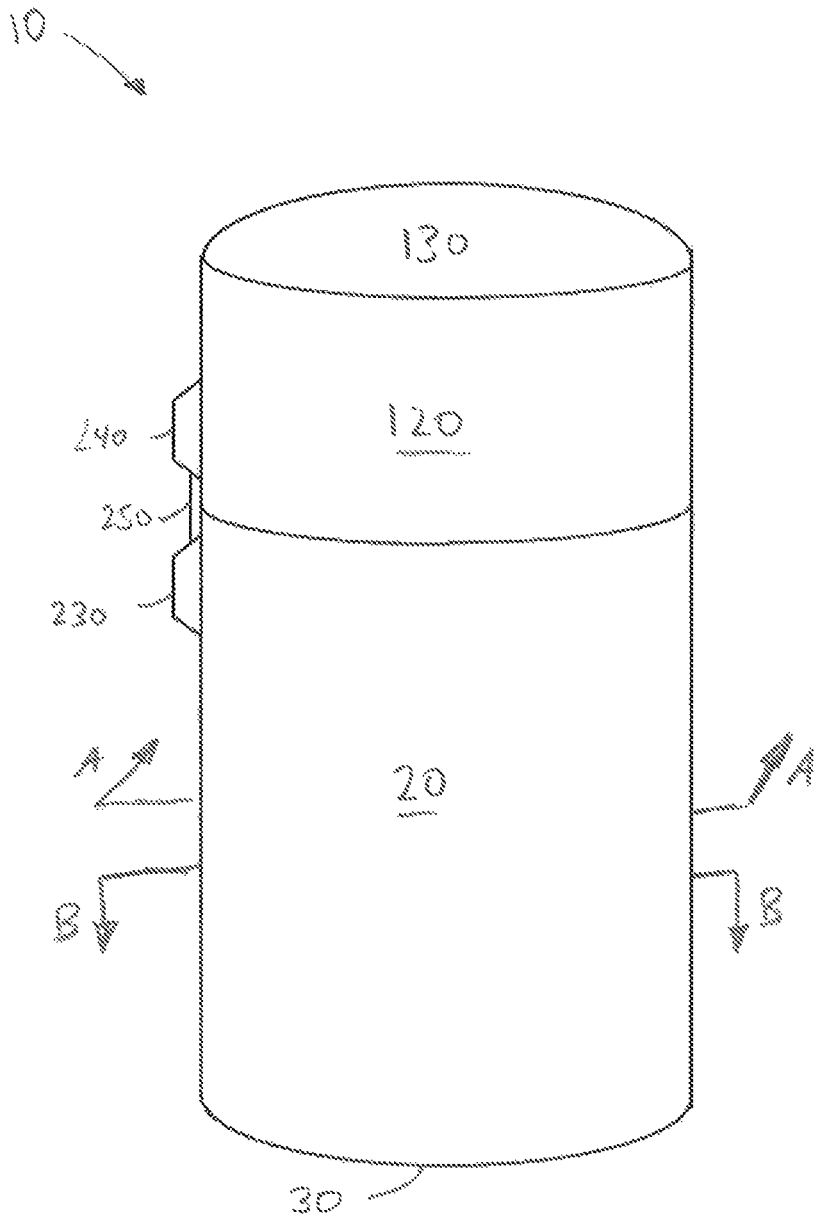
FIG. 1 is a perspective view of one embodiment of a beverage container insulation system in a closed position.
Figure 2:
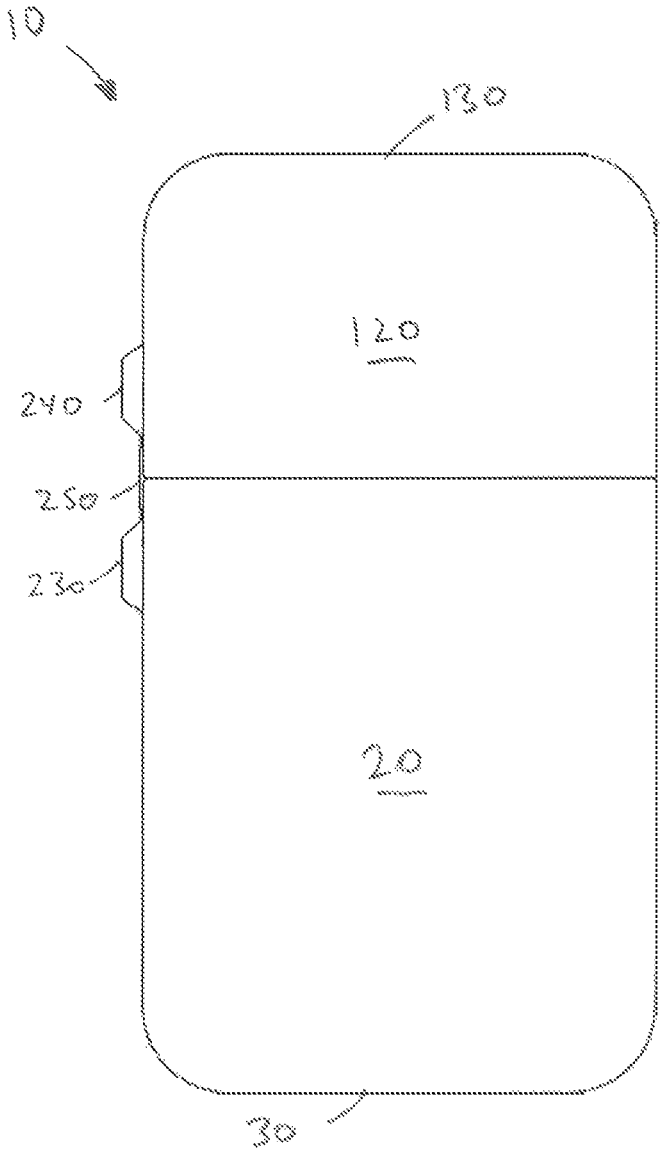
FIG. 2 is a side view of the beverage container insulation system of FIG. 1.
Figure 3:
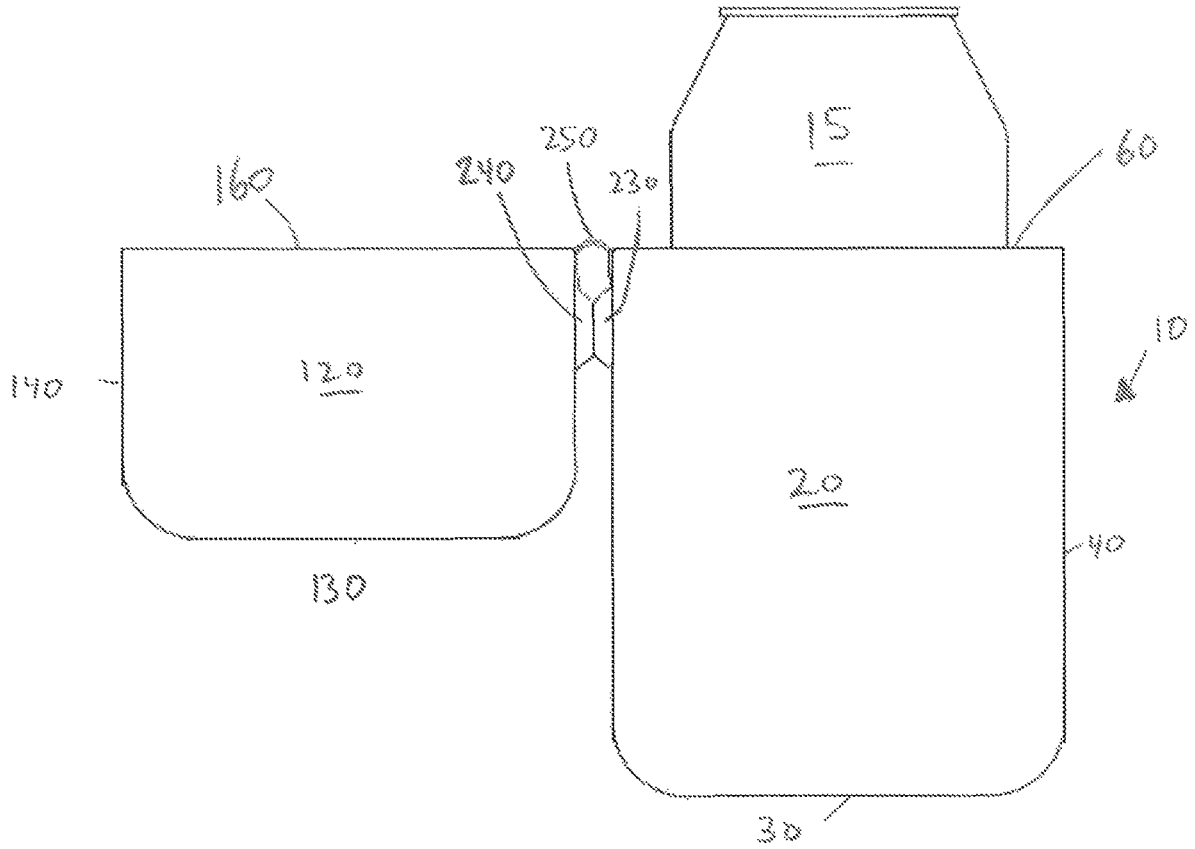
FIG. 3 is a side view of the beverage container insulation system of FIG. 1 in an opened position and containing a beverage can.

FIGS. 1-3 illustrate a beverage container insulation system 10 for maintaining the temperature of a beverage container 15, such as a beer can, pop can or other beverages. The beverage container insulation system 10 has a base 20 and a top 120 that are hingedly attached together.

Figure 4:
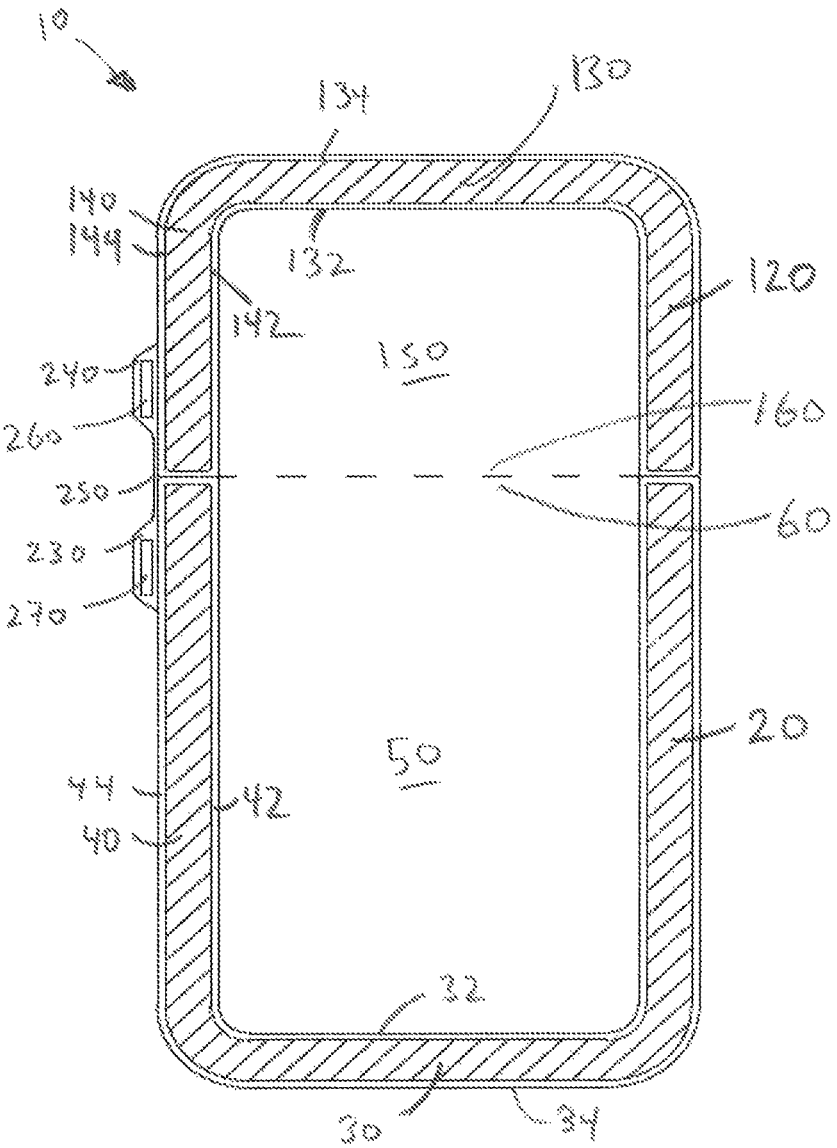
FIG. 4 is a cross-sectional view of the beverage container insulation system taken along line A-A of FIG. 1.

As shown in FIG. 4, the beverage container insulation system 10 has a bottom cavity 50 defined by at least one bottom sidewall 40 and a top cavity 150 defined by at least one top side wall 140. Preferably the bottom cavity 50 is greater in size than the top cavity 150 as shown in FIG. 4. However, it will be appreciated that bottom and top cavities 50, 150 may be equal in size or that bottom cavity 50 may be smaller in size than top cavity 150.

When bottom cavity 50 and top cavity 150 are combined, the combined volume and height can roughly correspond with those of a beverage container 15. For instance, a standard 355 ml beverage can is roughly 122 mm tall and a standard 473 ml beverage can is roughly 157 mm tall. When the beverage container insulation system 10 is loaded with a beverage container 15, the volume of the cavities 50, 150 can be such that the base 20 and top 120 tightly fit over the beverage container 15.

As illustrated in FIGS. 1-4, the base 20 has a bottom wall 30 and top has a top wall 130. In an alternate embodiment, base 20 may lack a bottom wall 30 such that the beverage container insulation system 10 insulates only the sides and top of a beverage container 15.

The top of base 20 has an opening 60 preferably shaped and sized to snugly receive the lower portion of a beverage container 15. The bottom of top 120 has an opening 160 preferably shaped and sized to snugly fit over the top of the upper portion of a beverage container 15. Base 20 preferably has a height that is greater than the height of half of the beverage container 15 and greater than the height of the top 120.

Base 20 may be manufactured from a pliable foam, pliable polymer plastic, glass, metal, other insulating material or any combination thereof. Preferably base 20 is made of an insulating material that is between 3 mm to 10 mm thick, though thicker or thinner materials are possible. In further embodiments, the base 20 can be textured with polymer plastic or rubber to fit ergonomically within a hand.

As best shown in FIG. 4, bottom wall 30 may have an inner surface 32 and an outer surface 34 positioned opposite opening 60. The inner surface 32 of bottom wall 30 may be connected to the inner surface 42 of bottom sidewall 40 and the outer surface 34 of bottom wall 30 may be connected to the outer surface 44 of bottom sidewall 40. Inner and outer surfaces 42, 44 may extend upwards away from bottom wall 30 towards opening 60.

Top wall 130 may have an inner surface 132 and an outer surface 134 positioned opposite opening 160. The inner surface 132 of top wall 130 may be connected to inner surface 142 of top sidewall 140 and the outer surface 134 of top wall 130 may be connected to outer surface 144 of top sidewall 140. Inner and outer surfaces 142, 144 may extend downwards from top wall 130 towards opening 160.

Top 120 may be manufactured from a pliable foam, pliable polymer plastic, glass, metal, other insulating material or any combination thereof. Preferably top 120 is made of an insulating material that is between 3 mm to 10 mm thick, though thicker or thinner materials are possible. Similar to base 20, top 120 can be textured with polymer plastic or rubber to fit ergonomically within a hand.

Top 120 can be in a closed position (shown in FIG. 2) or an opened position (shown in FIG. 3). When the top 120 is in the closed position, the beverage container 15 within the beverage container insulation system 10 can be fully encapsulated, thereby providing increased insulation relative to the opened position.

Figure 5:
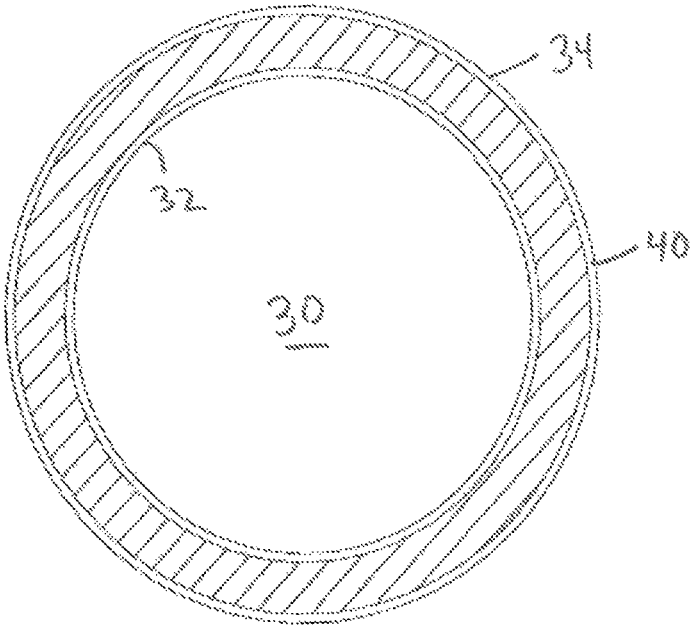
FIG. 5 is a cross-sectional view of the beverage container insulation system taken along line B-B of FIG. 1.

FIGS. 4-5 show a cross-sectional view of the top 120 and base 20 of the beverage container insulation system 10. The thickness of the bottom and top sidewalls 40, 140 can be seen as they surround a beverage container 15 contained therein.

Base 20 and top 120 may be hingedly attached together by an attachment element consisting of a bottom hinge element 230 on the base 20, a top hinge element 240 on top 120, and a bridging element 250 between the bottom and top hinge elements 230, 240.

As shown in FIG. 4, top hinge element 240 has an upper attachment element 260 and bottom hinge element 240 has a lower attachment element 270. The top 120 is shown in the closed position in FIG. 4. When the top 120 is in the opened position, upper attachment element 260 magnetically couples with lower attachment element 270. For instance, both upper and lower attachment elements 260, 270 may be magnetic. Alternatively, upper attachment element 260 may be magnetic and lower attachment element may be a ferromagnetic material, or vice versa.

The upper attachment element 260 and lower attachment element 270 can be integrated into the bottom and top hinge elements 230, 240 respectively using a pliable sewn fabric or pliable polymer plastic material.

Upper attachment element 260 and lower attachment element 270 can be defined as having a size smaller than the bottom and top hinge elements 230, 240. In some embodiments, the shape of the upper attachment element 260 and lower attachment element 270 can be polygonal or round. The upper attachment element 260 and lower attachment element 270 may be composed of iron, nickel, cobalt, magnetic alloys thereof, or other magnetic or ferromagnetic materials.

As illustrated in FIGS. 2 & 4, the bottom and top hinge elements 230, 240 may be positioned on the same side of the outer surfaces 44, 144 of the bottom sidewall 40 and the top sidewall 140 proximal to openings 60, 160. Bottom hinge element 230 and top hinge element 240 may be connected therebetween by a bridging element 250. Bridging element 250 may for instance be a band between the bottom hinge element 230 and the top hinge element 240. In some embodiments, the bottom and top hinge elements 230, 240 and bridging element 250 may be comprised of a pliable polymer plastic, metal, a pliable sewn fabric material, or other materials or combinations of materials.

In further embodiments, the upper attachment element 260 and lower attachment element 270 can be partly exposed to facilitate their magnetic coupling when the insulation system 10 is in the opened position. In yet further embodiments, the upper attachment element 260 and lower attachment element 270 can be covered with a pliable sewn fabric or pliable polymer plastic of sufficiently thin material to facilitate the magnetic coupling of the upper attachment element 260 to the lower attachment element 270.

Integration of the upper attachment element 260 and lower attachment element 270 into the bottom and top hinge elements 230, 240 is desirable because this orientation introduces little stress on the bridging element 250 which can result in longer product life.

In an alternate embodiment without bottom and top hinge elements 230, 204, upper attachment element 260 may be housed within top sidewall 140 and lower attachment element 270 may be housed within bottom sidewall. In this alternative embodiment, bridging element 250 may connect directly between outer surface 144 of the top sidewall 140 and outer surface 44 of the bottom sidewall.

Figure 6:
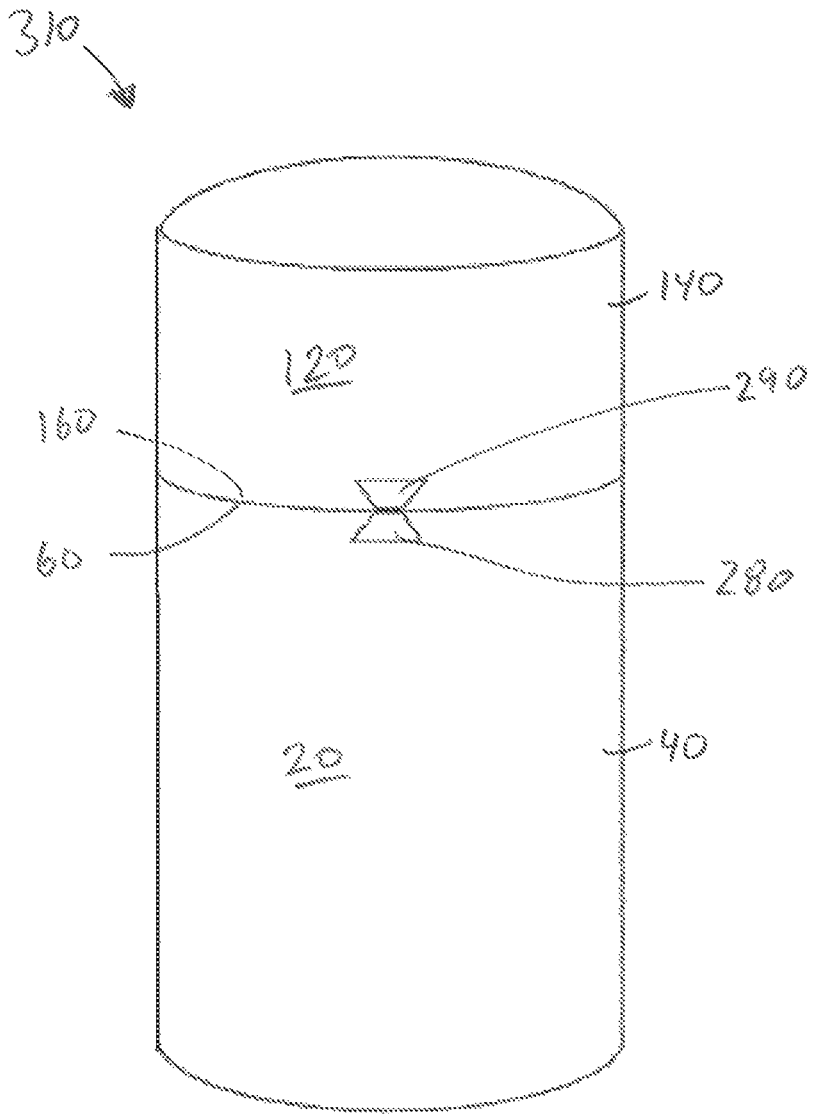
FIG. 6 is a perspective view of another embodiment of a beverage container insulation system with a closing element.
Figure 7:
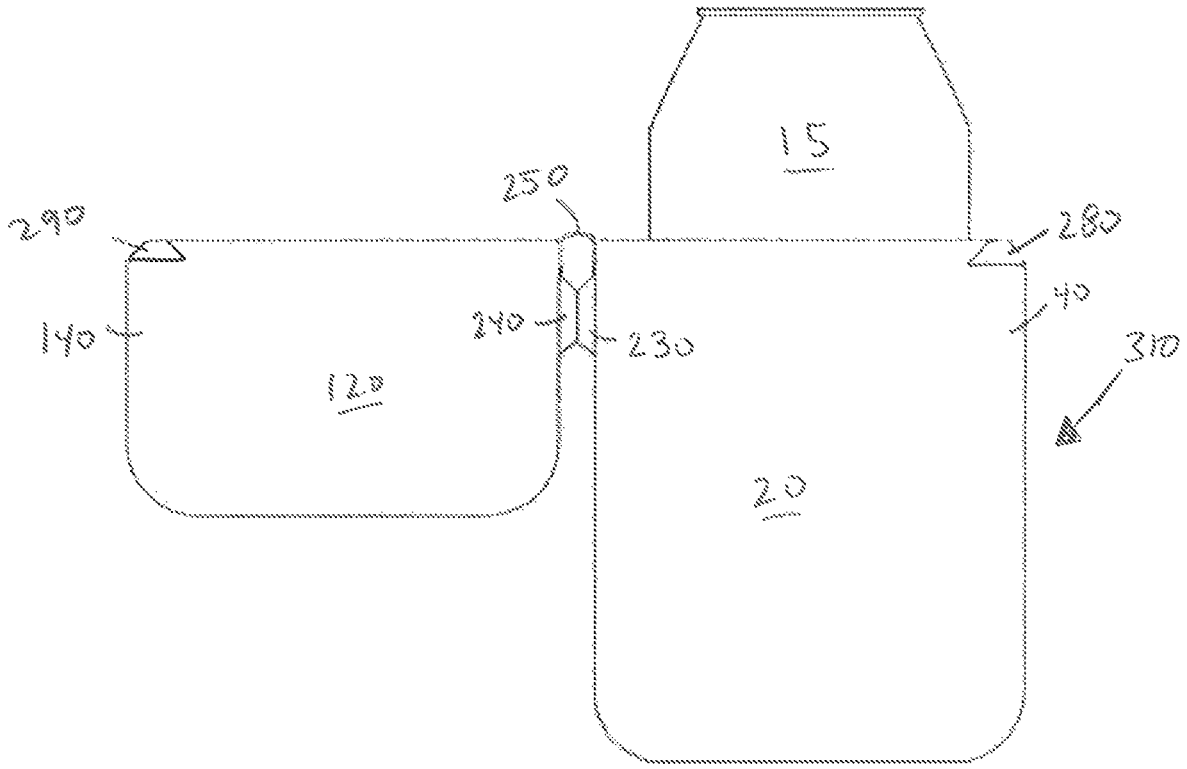
FIG. 7 is a side view of the beverage container insulation system of FIG. 6 in an opened position and containing a beverage can.

As illustrated in FIGS. 6-7, the beverage container insulation system 10 may have a first closing element 280 and second closing element 290. The material, shape and manufacture of the first closing element 280 and second closing element 290 can be substantially identical to those of the upper attachment element 260 and lower attachment element 270.

The first closing element 280 can be integrated into or on the side of the bottom sidewall 40 of base 20 at a position proximal to the opening 60 that is opposite or roughly opposite from the bottom and top hinge elements 230, 240.

The second closing element 290 can be integrated into or on the side of the top sidewall 140 of top 120 at a position proximal to the opening 160 that is opposite or roughly opposite from the bottom and top hinge elements 230, 240.

First and second closing elements 280, 290 may connect by magnetic coupling similar to the magnet coupling of lower and upper attachment elements 260, 270.

When the beverage container insulation system 10 is in the closed position, the first closing element 280 and second closing element 290 can be positioned directly across from each other on the bottom and top sidewalls 40, 140.

In some embodiments, the first closing element 280 and second closing element 290 can remain partly exposed to facilitate their magnetic coupling in the closed position. In yet further embodiments, the first closing element 280 and second closing element 290 are covered with a pliable sewn fabric or pliable polymer plastic of sufficiently thin material to facilitate the attraction of the first closing element 280 to the second closing element 290.

In operation, the beverage container insulation system 10 can be in a closed position (FIG. 2) or in an opened position (FIG. 3). In the closed position, the top 120 encapsulates the beverage container 15 and sits on top of the base 20. When the top 120 is in the closed position, the beverage container insulation system 10 has better insulating properties relative to the opened position (FIG. 3). An additional benefit of having the top 120 in the closed position is the prevention of unwanted particles falling into and contaminating the beverage inside the beverage container 15 when the user is not actively drinking.

When the top 120 is in the opened position (FIG. 3), the top 120 can be maintained in the opened position by upper attachment element 260 magnetically coupling with lower attachment element 270. This enables users to drink from the beverage container insulation system 10 without interference from the top 120. Further benefits of maintaining the beverage container insulation system 10 in a fixed opened position are that it reduces the risk of losing the top 120 and prevents the top 120 from excessive movement which may cause the beverage container insulation system 10 to topple.

As illustrated in FIGS. 2-3, alternating the position of the top 120 between the open and closed position is mediated by bottom and top hinge elements 230, 240 connected by a bridging element 250. As part of the bottom and top hinge elements 230, 240, the bridging element 250 maintains the connection between the top 120 and the base 20. Correspondingly, the upper attachment element 260 and the lower attachment element 270 can engage and magnetically couple to maintain the top 120 in a single orientation while in the opened position.

As illustrated in FIGS. 6-7, in the closed position, the first closing element 280 and second closing element 290 can engage and couple with each other. The joining of the first closing element 280 and second closing element 290 can function to maintain the beverage container insulation system 10 in the closed position, thereby ensuring that the beverage container 15 contained therein is fully encapsulated and receiving reasonably full insulation. This will also assist with preventing the contamination of the beverage within.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A beverage insulation apparatus movable between an opened position and a closed position, said beverage insulation apparatus comprising:

a base comprising a bottom sidewall defining a bottom cavity;

a top comprising a top sidewall defining a top cavity;

a bridging element connected between an outer surface of the top sidewall and an outer surface of the bottom sidewall, such that said top is pivotably connected to said base by the bridging element;

a lower attachment element on said bottom sidewall;

an upper attachment element on said top sidewall;

wherein said lower attachment element is unattached to said upper attachment element when said beverage insulation apparatus is in said closed position;

and wherein said lower attachment element magnetically couples with said upper attachment element when said beverage insulation apparatus is in said opened position, and wherein when said beverage insulation apparatus is in said closed position, the top cavity and the bottom cavity are combined to encapsulate a beverage container.

2. The beverage insulation apparatus of claim 1 wherein said lower attachment element is magnetic and said upper attachment element is ferromagnetic.

3. The beverage insulation apparatus of claim 1 wherein said lower attachment element is ferromagnetic and said upper attachment element is magnetic.

4. The beverage insulation apparatus of claim 1 wherein said lower attachment element is magnetic and said upper attachment element is magnetic.

5. The beverage insulation apparatus of claim 1 wherein said bridging element is made of a pliable polymer plastic.

6. The beverage insulation apparatus of claim 1 wherein said bridging element is made of metal.

7. The beverage insulation apparatus of claim 1 wherein said bridging element is made of a sewn fabric material.

8. The beverage insulation apparatus of claim 1 further comprising a lower closing element on said bottom sidewall;

an upper closing element on said top sidewall;

wherein said lower closing element is unconnected to said upper closing element when said beverage container apparatus is in said opened position;

and wherein said lower closing element is connected to said upper closing element when said beverage apparatus is in said closed position.

9. The beverage insulation apparatus of claim 1 wherein said base further comprises a bottom wall connected to said bottom sidewall.

10. The beverage insulation apparatus of claim 1 wherein said base and said top are made of a material selected from the group consisting of pliable foam, pliable polymer plastic, glass, and metal.

11. The beverage insulation apparatus of claim 1 wherein said base and said top are made of an insulating material that is between 3 mm to 10 mm thick.

12. The beverage insulation apparatus of claim 1 wherein said bottom sidewall is greater in height than said top sidewall.

13. The beverage insulation apparatus of claim 1 wherein the lower attachment element is provided on the outer surface of the bottom sidewall and wherein the upper attachment element is provided on the outer surface of the top sidewall.

* * * * *